United States Patent [19]

Phaff et al.

[11] Patent Number: 5,013,707

[45] Date of Patent: May 7, 1991

[54] PRESSURE- OR HEAT-SENSITIVE RECORDING MATERIAL

[75] Inventors: Rox Phaff, Itingen; Rudolf Zink, Therwil, both of Switzerland

[73] Assignee: Ciba-Geigy Corporation, Ardsley, N.Y.

[21] Appl. No.: 450,650

[22] Filed: Dec. 14, 1989

[30] Foreign Application Priority Data

Dec. 21, 1988 [CH] Switzerland ..... 4714/88

[51] Int. Cl.[5] ..... B41M 5/16; B41M 5/18; B41M 5/22

[52] U.S. Cl. ..... 503/212; 427/151; 503/217; 503/218; 503/220; 503/223

[58] Field of Search ..... 427/150–152; 503/217, 218, 220, 223, 212, 226

[56] References Cited

U.S. PATENT DOCUMENTS 4,688,059 8/1987 Schmidt et al. ..... 503/220

*Primary Examiner*—Bruce H. Hess

*Attorney, Agent, or Firm*—George R. Dohmann; Edward M. Roberts

[57] ABSTRACT

Pressure-sensitive or heat-sensitive recording material in which the color reactant system contains, as essential components, (A) an electron-donating compound of the formula

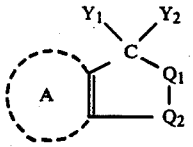

(1)

in which $Y_1$ and $Y_2$ are substituents which are detachable as anions and can be identical, different or bound to one another and $Q_1$ is —O—, —S—, >N—R or >N—NH—R, $Q_2$ is $—CH_2—$, —CO—, —CS— or $SO_2—$, R is hydrogen, $C_1$–$C_{12}$ alkyl, $C_5$–$C_{10}$ cycloalkyl, aryl or aralkyl and ring A is an aromatic radical which has 6 ring atoms and can contain an aromatic fused ring, it being possible not only for ring A but also for the fused ring to be substituted, (B) two organic condensation components which are identical to or different from one another and together are capable of forming a chromogenic compound with component (A) and (C) an electron-withdrawing and color-developing component.

28 Claims, No Drawings

PRESSURE- OR HEAT-SENSITIVE RECORDING MATERIAL

The present invention relates to a pressure-sensitive or heat-sensitive recording material in which the colour reactant system contains, as essential components, (A) an electron-donating compound of the formula

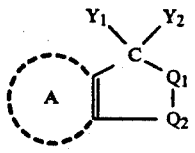

(1)

in which $Y_1$ and $Y_2$ are substituents which are detachable as anions and can be identical, different or bound to one another and $Q_1$ is —O—, —S—, >N—R or >N—NH—R, $Q_2$ is $—CH_2—$, —CO—, —CS— or $SO_2$— and R is hydrogen, $C_1$-$C_{12}$alkyl, $C_5$-$C_{10}$cycloalkyl, aryl such as phenyl or aralkyl such as benzyl and ring A is an aromatic radical which has 6 ring atoms and can contain an aromatic fused ring, it being possible not only for ring A but also for the fused ring to be substituted, (B) two organic condensation components which are identical to or different from one another and together are capable of forming a chromogenic compound with component (A) and (C) an electron-withdrawing and colour-developing component.

The compounds of the formula (1) (component (A)) contain, as part of their structure, the basic structure, for example, of a lactone, lactam, sultone, sultam or phthalan, and these basic structures are probably subject—before, during or after the reaction of component (A) with component (B)—upon contact with the colour developer (component (C)) to ring opening or bond cleavage.

Depending on the recording material, components (A), (B) and (C) make contact by pressure or heating and leave behind recorded images on the substrate. The colour produced is determined by the type of components (A) and (B), which represent the electron donor and form the chromogenic part. The colour formation is caused by component (C). By suitably combining the individual components, it is therefore possible to produce the desired colours, for example yellow, orange, red, violet, blue, green, grey, black or mixed colours. A further possible combination is to use components (A) and (B) together with one or more conventional colour formers, for example 3,3-bis(aminophenyl)phthalides such as CVL, 3-indolyl-3-aminophenylaza- or -diazaphthalides, 3,3-bis(indolyl)phthalides, 3-aminofluorans, 6-dialkylamino-2-dibenzylaminofluorans, 6-dialkylamino-3-methyl-2-arylaminofluorans, 3,6-bisalkoxyfluorans, 3,6-bisdiarylaminofluorans, leukoauramines, spiropyrans, spirodipyrans, benzoxazines, chromenopyrazoles, chromenoindoles, phenoxazines, phenothiazines, quinazolines, rhodamine lactams, carbazolylmethanes or triarylmethanes.

$Y_1$ and $Y_2$ substituents at the central (meso) carbon atom of the compound of the formula (1) are easily detachable substituents which form anions. These substituents can be halogen atoms, aliphatic, cycloaliphatic, araliphatic, aromatic or heterocyclic ether groups, for example alkoxy, cycloalkoxy, aralkoxy, aryloxy or heteroaryloxy, and also acyloxy groups, for example having the formula $$R'—(NH)_{n-1}—Q'—O— \quad (1a)$$

in which R' is an organic radical, preferably unsubstituted or, for example halogen- or cyano-substituted alkyl, cycloalkyl, aralkyl, aryl or heteroaryl, Q' is —CO— or $—SO_2$— and n is 1 or 2, preferably 1.

$Y_1$ and $Y_2$ as acyloxy are preferably a group of the formula R"—CO—O— in which R" is lower alkyl or phenyl. Detachable substituents which are particularly suitable are halogens, for example fluorine, bromine, iodine and in particular chlorine.

Detachable substituents $Y_1$ and $Y_2$ which are connected to one another via a carbon atom are advantageously a 5- or preferably 6-membered heterocyclic ring, in particular cyclic ether, thioether, ether ester or thioether ester groupings which preferably contain fused-on benzene rings which are unsubstituted or substituted, for example, by halogen atoms.

$Q_1$ is preferably an oxygen atom, while $Q_2$ is preferably $—SO_2$— and in particular —CO—. In $Q_1$ as >N—R or >N—NH—R, R is preferably hydrogen, methyl or phenyl.

A 6-membered aromatic ring A is preferably a benzene ring which is unsubstituted or substituted by halogen, cyano, nitro, lower alkyl, lower alkoxy, lower alkylthio, lower alkylcarbonyl, lower alkoxycarbonyl, amino, lower alkylamino, lower dialkylamino or lower alkylcarbonylamino. Ring A can also contain a fused aromatic ring, preferably a benzene ring, and is thus, for example, a naphthaline or phenanthrene ring.

The preferred 6-membered aromatic radicals represented by A are a 2,3-naphthalino, 1,2-naphthalino or 1,2-benzo radical which is unsubstituted or substituted by halogen, such as chlorine or bromine, nitro, lower alkyl, lower alkoxy, lower alkylthio or by a substituted or unsubstituted amino group as defined above, a 1,2-benzo radical which is unsubstituted or substituted by 4 chlorine atoms being particularly preferred.

Particularly important components (A) for the colour reactant system according to the invention has the formula

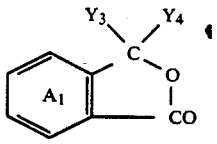

(2)

in which $A_1$ is a benzene ring which is unsubstituted or substituted by halogen, cyano, lower alkyl, lower alkylthio, lower alkoxy or lower dialkylamino and $Y_3$ and $Y_4$, independently of one another, are halogen or acyloxy, such as lower alkylcarbonyloxy or benzoyloxy and in particular chlorine or bromine.

Of the compounds of the formula (2), the lactone compounds in which $Y_3$ and $Y_4$ are halogen atoms such as bromine or in particular chlorine and ring $A_1$ is a benzene ring which is unsubstituted or substituted by halogen, lower alkyl, lower alkoxy or lower dialkylamino are preferred.

Of particular interest are the lactone compounds of the formula

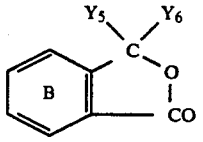

(3)

in which ring B is unsubstituted or substituted by lower alkyl, lower dialkylamino or 1 to 4 chlorine atoms and $Y_5$ and $Y_6$ are bromine or in particular chlorine.

Compounds of the formula (1) in which the detachable substituents $Y_1$ and $Y_2$ are halogen are prepared according to Org. Synth. Coll. Vol. II, 528 by converting, for example, the corresponding phthalic anhydride to the o-phthalyl dichloride, for example, using phosphorus pentachloride, thionyl chloride or benzotrichloride, if desired with the addition of zinc chloride, and then converting the symmetrical phthalyl dichloride to the unsymmetrical phthalyl dichloride, using aluminum chloride or even tin tetrachloride.

Compounds of the formula (1) in which $Y_1$ and $Y_2$ are connected to one another are prepared, for example, by reacting alkali metal salts of salicylic acid, their esters or ring-substituted products with halides of o-phthalic acid or their ring-substituted products (according to German Patent No. 400,790).

Specific examples of the compounds of the formulae (1) to (3) are 3,3-dichlorophthalide, 3,3-dibromophthalide, 3,3,5-trichlorophthalide, 3,3,5,6-tetrachlorophthalide, 3,3-difluoro-4,5,6,7-tetrachlorophthalide, 3,3,4,5,6,7-hexachlorophthalide, 3,3-dibromo-4,5,6,7-tetrachlorophthalide, 3,3,4,7-tetrachlorophthalide, 3,3,6,7-tetrachlorophthalide, 3,3,4,5,7-pentabromo-6-acetoxyphthalide, 3,3-diethoxyphthalide, 3,3-diethoxy-4,5,6,7-tetrachlorophthalide, 3,3-diethoxy-6,7-dichlorophthalide, 3,3-dimethoxy-4,7-dichlorophthalide, 3,3-dimethoxyphthalide, 3,3-dimethoxy-4,5,6,7-tetrachlorophthalide, 3-ethoxy-3,4,5,6,7-pentachlorophthalide, 3-ethoxy-4,5-dimethoxyphthalide, 3-ethoxy-3,6,7-trichlorophthalide, 3,3-diphenylthiophthalide, 3,3-bis(4'-nitrophenylthio)phthalide, 3,3-bis(4'-chlorophenylthio)phthalide, 3,3-bis(4'-methylphenylthio)phthalide, 3-methoxy-3-phenoxyphthalide, 3,3-bis(4'-tolyloxy)phthalide, 3,3-dichloro-6-dimethylaminophthalide, 3,3-dichloro-6-acetylaminophthalide, 3,3-dichloro-6-methylphthalide, 3,3-dichloro-6-tert-butylphthalide, furthermore 3-ethylspiro[1,4-dioxolane-5,1'(3'H)-isobenzofuran]-2,3'-dione, spiro-[3,4-benzo-1,5-dioxane-6,1'(3'H)-isobenzofuran]-2,3'-dione, 5-bromospiro[3,4-benzo-1,5-dioxane-6,1'(3'H)-isobenzofuran]-2,3'-dione, 3,5-dibromospiro[3,4-benzo-1,5-dioxane-6,1'(3'H)-isobenzofuran]-2,3'-dione, spiro[3,4-benzo-1,5-dioxane-6,1'(3'H)-tetrachloroisobenzofuran]-2,3'-dione, spiro[3,4-benzo-1,5-oxathiane-5,1'(3'H)-isobenzofuran]-2,3'-dione.

Components (B) which are used according to the invention and form chromogenic compounds with component (A) are preferably mono- or polycyclic aromatic or heteroaromatic compounds which complete a system of conjugated double bonds and, if necessary have oxochromic substituents, for example amino groups, substituted amino groups, such as lower dialkylamino, hydroxyl groups, ether groups such as alkoxy, thio groups or mercapto groups, such as alkylthio.

This type of compounds advantageously come from the series of unsubstituted or C- and/or N-substituted anilines, diarylamines, naphthylamines, N-substituted aminophenyl ethylene compounds, N-substituted aminophenylstyrene compounds, acylacetarylamides, monohydric or polyhydric phenols, phenol ethers, naphthols, naphtholcarbanilides, 3-aminophenol ethers, aminopyrazoles, aminothiazoles, pyrazolones, pyridones, pyrrols, thiophenes, quinolones, pyrimidones, barbituric acid, indoles, carbazoles, acridines, benzofurans, benzothiophene (thionaphthene), naphthothiophene, phenothiazine, pyrrolidines, piperidines, piperazines, morpholines, benzomorpholines, indolines, kairolines, dihydroquinolines, tetrahydroquinolines, julolidines.

The most preferred compounds are aniline compounds of the formula

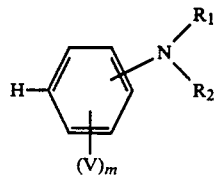

(4)

or indole compounds of the formula

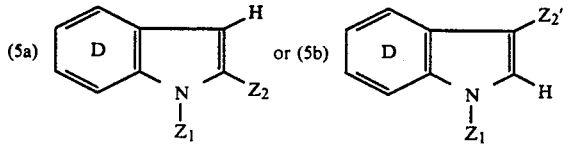

in which $R_1$ and $R_2$, independently of one another, are each hydrogen, alkyl which is unsubstituted or substituted by halogen, hydroxy, cyano or lower alkoxy and has a maximum number of 12 carbon atoms, acyl having 1 to 8 carbon atoms, cycloalkyl having 5 to 10 carbon atoms, or phenalkyl or phenyl which is unsubstituted or ring-substituted by halogen, cyano, lower alkyl, lower alkoxy, lower alkoxycarbonyl, —NX'X" or 4—NX'X"-phenylamino in which X' and X", independently of one another, are hydrogen, lower alkyl, cyclohexyl, benzyl or phenyl, or $R_1$ and $R_2$ together with the nitrogen atom which links them are a five- or six-membered, preferably saturated, heterocyclic radical. V is hydrogen, halogen, lower alkyl, $C_1$–$C_{12}$alkoxy, $C_1$–$C_{12}$acyloxy, benzyl, phenyl, benzyloxy, phenyloxy, halogen-, cyano-, lower alkyl- or lower alkoxy-substituted benzyl or benzyloxy, or the group $—NT_1T_2$. $T_1$ and $T_2$, independently of one another, are each hydrogen, lower alkyl, $C_5$–$C_{10}$cycloalkyl, unsubstituted or halogen-, cyano-, lower alkyl- or lower alkoxy-substituted benzyl, or acyl having 1 to 8 carbon atoms and $T_1$ is also unsubstituted or halogen-, cyano-, lower alkyl- or lower alkoxy-substituted phenyl. m is 1 or 2. $Z_1$ is hydrogen, unsubstituted or halogen-, hydroxyl-, cyano- or lower alkoxy-substituted alkyl having a maximum number of 12 carbon atoms, acyl having 1 to 12 carbon atoms or unsubstituted or halogen-, cyano-, lower alkyl- or lower alkoxy-substituted benzyl. $Z_2$ is hydrogen, lower alkyl or phenyl and $Z_2'$ is lower alkyl, cyclohexyl, benzyl or phenyl. The benzene ring D is unsubstituted or substituted by halogen, cyano, lower alkyl, lower alkoxy, lower alkoxycarbonyl, amino, lower monoalkylamino or lower dialkylamino. One V is preferably in the orthoposition relative to the linkage point. $—NR_1R_2$ is preferably in the para-position relative to the linkage point.

In the definition of components (A) and (B), lower alkyl, lower alkoxy and lower alkylthio are preferably those groups or group components which have 1 to 6, in particular 1 to 4, carbon atoms. Examples of these types of groups are ethyl, n-propyl, isopropyl, n-butyl, sec-butyl, tert-butyl, amyl, isoamyl or hexyl and methoxy, ethoxy, isopropoxy, isobutoxy or tert-butoxy or methylthio, ethylthio, propylthio or butylthio.

Halogen is, for example, fluorine, bromine or preferably chlorine.

Acyl is in particular formyl, lower alkylcarbonyl, for example acetyl or propionyl, or benzoyl. Further acyl radicals can be lower alkylsulfonyl, for example methylsulfonyl or ethylsulfonyl and phenylsulfonyl. Benzoyl and phenylsulfonyl can be substituted by halogen, methyl, methoxy or ethoxy.

Alkyl groups as R, $R_1$, $R_2$ and $Z_1$ substituents can be straight-chain or branched. Examples of these alkyl radicals are methyl, ethyl, n-propyl, isopropyl, n-butyl, sec-butyl, tert-butyl, amyl, isoamyl, n-hexyl, 2-ethylhexyl, n-heptyl, n-octyl, 1,1,3,3-tetramethylbutyl, isooctyl, n-nonyl, isononyl or n-dodecyl.

Substituted alkyl radicals in $R_1$, $R_2$ and $Z_1$ are in particular cyanoalkyl, halogenoalkyl, hydroxyalkyl, alkoxyalkyl each preferably having a total of 2 to 8 carbon atoms, for example 2-cyanoethyl, 2-chloroethyl, 2-hydroxyethyl, 2-methoxyethyl, 2-ethoxyethyl, 2,3-dihydroxypropyl, 2-hydroxy-3-chloropropyl, 3-methoxypropyl, 4-methoxybutyl or 4-propoxybutyl.

Examples of cycloalkyl in R, $R_1$, $R_2$, $T_1$ and $T_2$ are cyclopentyl, cycloheptyl or preferably cyclohexyl. The cycloalkyl radicals can have one or several $C_1$–$C_4$alkyl radicals, preferably methyl groups and have a total of 5 to 10 carbon atoms.

The acyloxy radical in V is for example formyloxy, lower alkylcarbonyloxy, for example acetyloxy or propionyloxy, or benzoyloxy. A $C_1$–$C_{12}$alkoxy radical in V can be a straight-chain or branched group, for example methoxy, ethoxy, isopropoxy, n-butoxy, tert-butoxy, amyloxy, 1,1,3,3-tetramethylbutoxy, n-hexyloxy, n-octyloxy or dodecyloxy.

A heterocyclic radical formed by the substituent pair ($R_1$ and $R_2$) together with the common nitrogen atom is, for example, pyrrolidino, piperidino, pipecolino, morpholino, thiomorpholino, piperazino, N-alkylpiperazino, for example, N-methylpiperazino, N-phenylpiperazino or N-alkylimidazolino. Preferred saturated heterocyclic radicals as —$NR_1R_2$ are pyrrolidino, piperidino or morpholino.

Advantageously, V can be hydrogen, halogen, lower alkyl, for example methyl, benzyloxy, $C_1$–$C_8$alkoxy, primarily lower alkoxy, for example methoxy, ethoxy, n-propoxy, isopropoxy, n-butoxy or tert-butoxy, or the group —$NT_1T_2$, one of the radicals $T_1$ and $T_2$ being preferably $C_1$–$C_8$acyl or lower alkyl and the other hydrogen or lower alkyl. In this case, the acyl radical is in particular lower alkylcarbonyl, for example acetyl or propionyl. Preferably, V is acetylamino, dimethylamino, benzyloxy or in particular lower alkoxy and especially ethoxy or hydrogen.

$R_1$ and $R_2$ as phenalkyl advantageously have a total of 7 to 9 carbon atoms and are usually α-methylbenzyl, phenethyl, phenisopropyl or primarily benzyl, which preferably can also be ring substituted.

Preferred substituents in the benzyl group of the R, T and Z radicals, in the phenyl group of $R_1$, $R_2$ and $T_1$ and in the benzyloxy group of V are, for example, halogen, methyl or methoxy. Examples of these aliphatic or aromatic radicals are p-methylbenzyl, o- or p-chlorobenzyl, 2,5-dimethylbenzyl, o- or p-tolyl, xylyl, 2,6-dimethylphenyl, o-, m- or p-chlorophenyl, o- or p-methoxyphenyl, o- or p-chlorobenzyloxy or o- or p-methylbenzyloxy.

The substituents $R_1$ and $R_2$ are preferably cyclohexyl, benzyl, tolyl, phenethyl, cyano lower alkyl, for example β-cyanoethyl or primarily lower alkyl, for example methyl, ethyl or n-butyl. —$NR_1R_2$ is preferably also pyrrolidinyl.

The indole substituent $Z_1$ is preferably hydrogen, benzyl, acetyl, propionyl or in particular $C_1$–$C_8$alkyl, for example methyl, ethyl, n-butyl or n-octyl.

$Z_2$ is preferably phenyl or especially methyl. $Z_2'$ is preferably lower alkyl.

The benzene ring D is preferably not further substituted. Any substituents on D are in particular halogen, lower alkyl, for example methyl, tert-butyl, lower alkoxy or lower dialkylamino such as dimethylamino.

Specific examples of components (B) are 2-amino-4-methoxytoluene, N,N-dimethylaniline, N,N-diethylaniline, N-phenylpyrrolidine, N-3-ethoxyphenylpyrrolidine, N-phenylmorpholine, m-phenetidine, 3-ethoxy-N,N-dimethylaniline, 3-ethoxy-N,N-diethylaniline (N,N-diethyl-m-phenetidine), 3-ethoxy-N,N-dibutylaniline, 3-n-butoxy-N,N-di-n-butylaniline, 1,3-bisdimethylaminobenzol, 3-acetylamino-N,N-dimethylaniline, N-methyl-N-4-methylphenylaniline, 4-ethoxydiphenylamine, N-methyl-diphenylamine, N,N-dibenzylaniline, N-phenyltoluidine, N-phenylxylidine, 3-N,N-(di-2-cyclohexylethyl)aminophenol, 3-diethylaminophenol, 1,1-bis(4-diethylaminophenyl)ethylene, 1-(4-diethylaminophenyl)-1-(4-methoxyphenyl-)ethylene, N-cyclohexyl-N-methylaniline, thiophene, N-methylpyrrole, kairoline, julolidine, N-ethylcarbazol, 2-methylindole, 2-phenylindole, 1,2-dimethylindole, 1-n-butyl-2-methylindole, 1-ethyl-2-methylindole, 1-n-octyl-2-methylindole, 1-methyl-2-phenylindole, 1-ethyl-2-phenylindole, 3-methyl-6-dimethylaminoindole, 1-phenyl-3-methyl-5-pyrazolone, benzothiazol-2-yl-acetonitrile, 1-phenyl-5-methyl-3-pyrazolone, 1-(2'-chlorophenyl)-5-methyl-3-pyrazolone, thionaphthene, α-naphthol, β-naphthol, α-naphthylamine, β-naphthylamine, 1-methyl-1,2,3,4-tetrahydroquinoline, N-ethyl-N-2-chloroethylaniline, 1-benzyl-2-methylindoline, N-ethyl-N-benzylaniline, phenothiazine, 10-methyl-phenothiazine, 10-acetylphenothiazine, 2,3,3-trimethylindolenine, 1,3,3-trimethyl-2-methyleneindoline.

Preferred components (B) are also phthalide and especially fluoran compounds, which contain at least one primary amino group or one amino group monosubstituted by lower alkyl, cyclohexyl or benzyl. These phthalide and fluoran compounds are described, for example, in FR-A No. 1,553,291, GB-A No. 1,211,393, DE-A No. 2,138,179, DE-A No. 2,422,899 and EP-A No. 138,177.

Specific examples of these components (B) are: 2-amino-3-chloro-6-diethylaminofluoran, 2-amino-6-dibutylaminofluoran, 6-amino-3-chlorofluoran, 2-amino-6-diethylaminofluoran, 2-methylamino-6-dimethylaminofluoran, 2-ethylamino-6-diethylaminofluoran, 2-methylamino-6-diethylaminofluoran, 2-n-butylamino-6-diethylaminofluoran, 2-n-octylamino-6-diethylaminofluoran, 2-sec-butylamino-6-diethylaminofluoran, 2-benzylamino-6-diethylaminofluoran, 2,3-dimethyl-6-ethylaminofluoran, 2,3,7-trimethyl-6-ethylaminofluoran, 2,3,7-trimethyl-6-ethylamino-5'(6')-tert-butylfluoran, 2-chloro-3,7-dimethyl-6-ethylamino-5'(6')-tert-butylfluoran, 2-tert-butyl-6-ethylamino-7-methyl-5'(6')-tert-butylfluoran, 3-chloro-6-cyclohexylaminofluoran, 2,7-dimethyl-3,6-bis-ethylaminofluoran, 2-(2'-chloroanilino-6-ethylamino-7-methylfluoran, 3,3-bis-(4'-dimethylaminophenyl)-6-aminophthalide, 3,3-bis-(4'-ethylaminophenyl)-6-dimethylaminophthalide.

The relative amounts in which components (A) and (B) are used are not critical, but they are preferably used in stoichiometric amounts.

Not only component (A) but also components (B) can be used either individually or in the form of a combination of two or several thereof.

Using two identical components (B) usually leads to the formation of symmetrically substituted polycyclic chromogenic compounds. On the other hand, using two components (B) which are different from one another more likely leads to the formation of unsymmetrically substituted chromogenic compounds.

As component (C), inorganic or organic colour developers which are known for recording materials and are capable of withdrawing electrons (electron acceptors) can be used.

Typical examples of inorganic developers are active clay substances, such as attapulgite clay, acid clay, bentonite, montmorillonite; activated clay, for example acid-activated bentonite or montmorillonite and halloysite, kaolin, zeolite, silica, zirconium dioxide, alumina, aluminium sulfate, aluminium phosphate or zinc nitrate.

Preferred inorganic colour developers are Lewis acids, for example aluminium chloride, aluminium bromide, zinc chloride, iron(III) chloride, tin tetrachloride, tin dichloride, tin tetrabromide, titanium tetrachloride, bismuth trichloride, tellurium dichloride or antimony pentachloride.

As organic dye developers, solid carboxylic acids, advantageously aliphatic dicarboxylic acids, for example tartaric acid, oxalic acid, maleic acid, citric acid, citraconic acid or succinic acid and alkylphenol acetylene resin, maleic acid/rosin resin, carboxypolymethylene or partially or completely hydrolysed polymers of maleic anhydride with styrene, ethylene or vinyl methyl ether can be used.

Suitable organic colour developers are in particular compounds having a phenolic hydroxyl group. These can be both monohydric and also polyhydric phenols. These phenols can be substituted by halogen atoms, carboxyl groups, alkyl radicals, aralkyl radicals, such as α-methylbenzyl, α,α-dimethylbenzyl, aryl radicals, acyl radicals, such as arylsulfonyl or alkoxycarbonyl radicals or aralkoxycarbonyl radicals, such as benzyloxycarbonyl.

Specific examples of phenols which are suitable as component (C) are 4-tert-butylphenol, 4-phenylphenol, methylene-bis(p-phenylphenol), 4-hydroxydiphenyl ether, α-naphthol, β-naphthol, methyl or benzyl 4-hydroxybenzoate, methyl 2,4-dihydroxybenzoate, 4-hydroxydiphenyl sulfone, 4'-hydroxy-5-methyldiphenyl sulfone, 4'-hydroxy-4-isopropoxydiphenyl sulfone, 4-hydroxyacetophenone, 2,4-dihydroxybenzophenone, 2,2'-dihydroxydiphenyl, 2,4-dihydroxydiphenyl sulfone, 4,4'-cyclohexylidenediphenol, 4,4'-isopropylidenediphenol, 4,4'-isopropylidene bis(2-methylphenol), 4,4-bis(4-hydroxyphenyl)valeric acid, resorcinol, hydroquinone, pyrogallol, phloroglucine, p-, m-, o-hydroxybenzoic acid, hydroxyphthalic acid, 3,5-di(α-methylbenzyl)salicylic acid, 3,5-di(α,α-dimethylbenzyl)salicylic acid, salicylosalicylic acid, alkyl gallate, gallic acid, 1-hydroxy-2-naphthoic acid or phenol/formaldehyde prepolymers (novolaks), which can also be modified by zinc. Of the carboxylic acids listed, the salicylic acid derivatives are preferred and are preferably used as zinc salts. Particularly preferred zinc salicylates are described in EP-A No. 181,283 or DE-A No. 2,242,250.

Organic complexes or zinc thiocyanate and in particular the antipyrine complex of zinc thiocyanate or the pyridine complex of zinc thiocyanate, such as are described in EP-A No. 97,620, are very suitable as component (C).

Preferred components (C) include a zinc salt of a salicylic acid derivative, a zinc salt of a phenolic resin or especially an acid clay.

The developers can additionally also be used in a mixture with pigments which are unreactive per se or slightly reactive or further auxiliaries such as silica gel or light stabilizers, for example 2-(2'-hydroxyphenyl)-benzotriazoles, benzophenones, cyanoacrylates, phenyl salicylates. Examples of these pigments are: talcum, titanium dioxide, alumina, aluminium hydroxide, zinc oxide, chalk, clays such as kaoline, and organic pigments, for example urea/formaldehyde condensation products (BET surface area 2–75 $m^2/g$) or melamine/formaldehyde condensation products.

The mixing ratio of component (C) to components (A) and (B) depends on the type of the three components, the nature of the colour formation, the pressure and the colour reaction temperature and, of course, also on the desired colour depth. However, satisfactory results are achieved, if the colour-developing component (C) is used in amounts of 0.1 to 100 parts by weight per part combined components (A) and (B).

When component (A) and components (B) are used for the pressure-sensitive recording material, they are preferably dissolved together or even separately in an organic solvent, and the solutions obtained are advantageously encapsulated by processes, as described, for example, in U.S. Pat. Nos. 2,712,507, 2,800,457, 3,016,308, 3,429,827 and 3,578,605 or in British Patent Nos. 989,264, 1,156,725, 1,301,052 or 1,355,124. Microcapsules which are formed by interfacial polymerization, for example polyester, polycarbonate, polysulfonamide, polysulfonate, but in particular polyamide or polyurethane capsules, are also suitable. In some cases, it is sufficient only to encapsulate component (A). Encapsulation is usually required to separate components (A) and (B) from component (C) and thus prevent premature activation. The latter can also be achieved by incorporating components (A) and (B) in foam-, sponge- or honeycomb-like structures.

Examples of suitable solvents are preferably nonvolatile solvents, for example halogenated benzene, diphenyls or paraffin, for example chlorinated paraffin, trichlorobenzene, monochlorodiphenyl, dichlorodiphenyl or trichlorodiphenyl; esters, for example dibutyl adipate, dibutyl phthalate, dioctyl phthalate, butyl benzyl adipate, trichloroethyl phosphate, trioctyl phosphate, tricresyl phosphate; aromatic ethers such as benzyl phenyl ether; hydrocarbon oils, such as paraffin oil or kerosine, for example isopropyl-, isobutyl-, sec-butyl- or tert-butyl-alkylated derivatives of diphenyl, naphthaline or terphenyl, dibenzyltoluene, partially hydrogenated terphenyl, mono- to tetra-$C_1$–$C_3$alkylated diphenyl alkanes, dodecylbenzene, benzylated xylenes, or further chlorinated or hydrogenated, fused aromatic hydrocarbons. Often mixtures of different solvents, in particular mixtures of paraffin oils or kerosine and diisopropylnaphthaline or partially hydrogenated terphenyl are used to achieve optimum solubility for the colour formation, rapid and deep coloration and a viscosity which is favoured for microencapsulation.

Microcapsules containing components (A) and (B) can be used for preparing pressure-sensitive copying materials of a wide range of known types. The different systems differ mainly in the arrangement of the capsules, the colour reactants and the substrate.

An advantageous arrangement is one in which the encapsulated components (A) and (B) are present in the form of a layer on the back of a transfer sheet and the electron acceptor (component (C)) in the form of a layer on the front of a receptor sheet. In a different arrangement of the components, the microcapsules containing the components (A) and (B) and the developer (component (C)) are present in or on the same sheet in the form of one or several individual layers or are present in the paper pulp.

To achieve the desired colour, the capsule material containing the components A and B can be mixed with further capsules which contain conventional colour formers. Similar results are obtained by encapsulating components A and B together with one or more of the conventional colour formers.

The capsules are preferably attached to the substrate by means of a suitable binder. Since paper is the preferred substrate, this binder predominantly includes paper coating agents, for example gum arabic, polyvinyl alcohol, hydroxymethyl cellulose, casein, methyl cellulose, dextrin, starch, starch derivatives or polymer latices. Examples of the latter are butadiene/styrene copolymers or acrylic homo- or copolymers.

The paper used includes not only standard papers made of cellulose, but also papers in which the cellulose fibres have been replaced (partially or completely) by fibres made of synthetic polymers. The substrate can also be a plastic sheet.

Preferably, the copying material can also comprise a capsule-free layer containing components (A) and (B) and a colour-developing layer which contains at least one inorganic metal salt, in particular halides or nitrates, for example zinc chloride, tin chloride, zinc nitrate or mixtures thereof, as colour developer (component (C)).

The ternary colour formation system used according to the invention and consisting of components (A), (B) and (C) is also suitable for preparing a heat-sensitive recording material for thermography, in which components (A), (B) and (C) make contact with one another upon heating with a formation of colours and leave behind recorded images on the substrate.

The heat-sensitive recording material usually contains at least one substrate, components (A), (B) and (C) and, if necessary, also a binder and/or wax. If desired, activators and sensitizers can also be present in the recording material.

Thermoreactive recording systems comprise, for example, heat-sensitive recording and copying materials and papers. These systems are used, for example, for recording information, for example in electronic computers, teleprinters, teletypewriters or in recording and measuring instruments, for example electrocardiographs. The image formation (marking) can also be carried out manually by means of a heated pen. A further means for producing markings by heat are laser beams.

The thermoreactive recording material can be structured in such a way that components (A) and (B) are dissolved or dispersed in a binder layer and the developer (component (C)) is dissolved and dispersed in the binder in a second layer. Another possibility is to disperse all components in the same layer. The layer or layers are softened or melted in specific areas by means of heat, as a result of which the desired colour is developed immediately in the heated areas.

Preferably, meltable film-forming binders are used for preparing the heat-sensitive recording material. These binders are usually water-soluble, while components (A), (B) and (C) are insoluble in water. The binder should be capable of dispersing all components at room temperature and fixing them on the substrate.

Examples of water-soluble or at least water-swellable binders are hydrophilic polymers, such as polyvinyl alcohol, polyacrylic acid, hydroxyethylcellulose, methylcellulose, carboxymethylcellulose, polyacrylamide, polyvinylpyrrolidone, carboxylated butadiene/styrene copolymers, gelatins, starch or esterified corn starch.

In the case where components (A), (B) and (C) are present in two, three or, depending on components (B) even four separate layers, water-insoluble binders, that is, binders soluble in nonpolar or only weakly polar solvents, for example natural rubber, synthetic rubber, chlorinated rubber, alkyde resins, polystyrene, styrene/butadiene mixed polymers, polymethyl acrylates, ethylcellulose, nitrocellulose and polyvinylcarbazole can be used. However, the preferred arrangement is one in which all components are present in one layer in a water-soluble binder.

To ensure the stability of the heat-sensitive recording material or the density of the developed image, the material can be provided with an additional protective layer. This type of protective layer usually consists of water-soluble and/or water-insoluble resins which constitute conventional polymeric materials or aqueous emulsions of these polymeric materials.

Specific examples of water-soluble polymeric materials are polyvinyl alcohol, starch, starch derivates, cellulose derivatives, such as methoxycellulose, hydroxyethylcellulose, carboxymethylcellulose, methylcellulose or ethylcellulose, sodium polyacrylate, polyvinylpyrrolidone, polyacrylamide/acrylic ester copolymers, acrylamide/acrylic ester/methacrylic acid copolymers, alkali metal salts of styrene/maleic anhydride copolymers, alkali metal salts of isobutene/maleic anhydride copolymers, polyacrylamide, sodium alginate, gelatin, casein, water-soluble polyesters or carboxyl-modified polyvinyl alcohol.

If necessary, for example, the following water-insoluble resins can be used in the protective layer in combination with the water-soluble polymer resins mentioned: polyvinyl acetate, polyurethanes, styrene/butadiene copolymers, polyacrylic acid, polyacrylic esters, vinyl chloride/vinyl acetate copolymers, polybutylmethacrylate, ethylene/vinyl acetate copolymers and styrene/-butadiene/acrylic derivatives copolymers.

Not only the thermoreactive layers but also the resin layers can contain further additives. To improve the whiteness or the thermal printing head suitability of the recording material and to prevent the heated pen or plate from becoming glued on, these layers can contain, for example antioxidants, light stabilizers, solubilizers, talcum, titanium dioxide, zinc oxide, alumina, aluminium hydroxide, calcium carbonate, (e.g. chalk), clays or even organic pigments, for example urea/formaldehyde polymers. To restrict the colour formation to a limited temperature range, substances such as urea, thiourea, diphenylthiourea, acetamide, acetanilide, benzenesulfanilide, ethylenebis(stearamide), stearamide, phthalic anhydride, benzyl benzyloxybenzoate, metal stearate, for example zinc stearate, phthalonitrile, dimethyl terephthalate, dibenzyl isophthalate, dibenzylterephthalate, benzyldiphenyl, or other suitable meltable products which induce the simultaneous melting of the colour-forming components and the developer can be added.

Preferably, thermographic recording materials contain waxes, for example carnaub wax, montan wax, paraffin wax, polyethylene wax, condensation products of higher fatty amides and formaldehyde or condensation products of higher fatty acids and ethylenediamines.

To improve the applicability of the thermochromatic materials, components (A), (B) and (C) can be microencapsulated. To this end, any desired abovementioned processes which are known per se for encapsulating colour formers or other active substances in microcapsules can be used.

In the examples which follow, parts are by weight.

EXAMPLE 1

Solution A is prepared by dissolving 1.0 g of 3,3-dichlorophthalide in 50 ml of toluene at 25° C.

Solution B is prepared by dissolving 2 g of 2-phenylindole in 50 ml of toluene at 50° C.

Using a 10 μm blade, solution B is then brushed onto a sheet of paper which is coated on the front with acid-modified bentonite as colour developer (CF sheet). Solution A is then also brushed onto the sheet, immediately resulting in a black colour which has excellent light fastness.

EXAMPLE 2

Solutions A and B prepared according to Example 1 are mixed in a ratio of 1:1 and brushed onto the front of a sheet of paper coated with acid-modified bentonite, immediately resulting in a black colour.

EXAMPLE 3

The procedure as described in Example 1 is repeated, using a solution C of 2 g of 1-methyl-2-phenylindole instead of solution B, to give a violet colour on the front of the paper coated with acid-modified bentonite.

EXAMPLE 4

2 g of 2-phenylindole are dissolved in 35 g of toluene at 50° C. 1 g of 3,3-dichlorophthalide is dissolved in 22 g of toluene at 25° C. The two solutions are mixed, and 12 g of polyvinyl acetate, 8 g of calcium carbonate and 2 g of titanium dioxide are added with stirring. The resulting suspension is brushed onto a sheet of paper by means of a 10 μm blade. On top of this sheet of paper is placed a second sheet of paper whose bottom surface is coated with a mixture consisting of 1 part of an amide wax, 1 part of a stearine wax and 1 part of zinc chloride, the weight of the coating being 3 g/m$^2$. Pressure is applied to the upper sheet by hand or typewriter writing. A violet colour develops on the sheet coated with solutions.

EXAMPLE 5

100 mg of 3,3-dichlorophthalide and 129 mg of 2-methylindole are dissolved together in 10 ml of diisopropylnaphthaline and applied to a paper coated with acid-modified clay by means of an intaglio printing plate. A lightfast red colour develops.

EXAMPLE 6

100 mg of 3,3-dichlorophthalide and 171 mg of 3-methyl-6-dimethylaminoindole are dissolved together in 10 ml of diisopropylnaphthaline, and the solution is applied to a paper coated with acid-modified clay by means of an intaglio printing plate. A lightfast deep violet colour develops. The colouring shows absorption extending into the near IR region.

EXAMPLE 7

100 mg of 3,3-dichlorophthalide and 249 mg of 1-(4-dimethylaminophenyl)-1-(4-methoxyphenyl)ethylene are dissolved together in 10 ml of diisopropylnaphthaline, and the solution is applied to a paper coated with acid-modified clay by means of an intaglio printing plate. A lightfast violet colour develops.

EXAMPLE 8

20 mg of 3,3-dichlorophthalide and 100 mg of 2-n-octylamino-6-diethylaminofluoran are dissolved together in 10 ml of diisopropylnaphthaline, and the solution is applied to a paper coated with acid-modified clay by means of an intaglio printing plate. A red colour develops.

What is claimed is:

1. A pressure-sensitive or heat-sensitive recording material comprising a substrate and a colour reactant system in which the colour reactant system comprises, as essential components, (A) an electron-donating compound of the formula

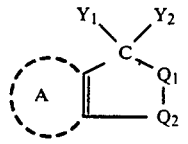

(1)

in which $Y_1$ and $Y_2$ are substituents which are detachable as anions and can be identical, different or bound to one another and $Q_1$ is —O—, —S—, >N—R or >N—NH—R, $Q_2$ is —$CH_2$—, —CO—, —CS— or $SO_2$—, R is hydrogen, $C_1$–$C_{12}$alkyl, $C_5$–$C_{10}$cycloalkyl, aryl or aralkyl and ring A is an aromatic radical which has 6 ring atoms and can contain an aromatic fused ring, it being possible not only for ring A but also for the fused ring to be substituted, (B) two organic condensation components which are identical to or different from one another and together are capable of forming a chromogenic compound with component (A) and (C) an electron-withdrawing and colour-developing component.

2. A recording material according to claim 1, wherein $Y_1$ and $Y_2$ in formula (1), independently of one another, are each halogen, an aliphatic, cycloaliphatic, araliphatic, aromatic or heterocyclic ether group or an acyloxy group.

3. A recording material according to claim 1, wherein $Y_1$ and $Y_2$ in formula (1) are halogen.

4. A recording material according to claim 1, wherein in formula (1) $Q_1$ is oxygen and $Q_2$ is —CO—.

5. A recording material according to claim 1, wherein ring A in formula (1) is a substituted or unsubstituted benzene, naphthaline or phenanthrene ring.

6. A recording material according to claim 1, wherein component (A) is a lactone compound of the formula

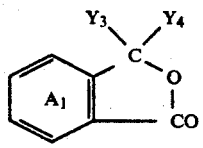

(2)

in which $A_1$ is a benzene ring which is unsubstituted or substituted by halogen, cyano, lower alkyl, lower alkylthio, lower alkoxy or lower dialkylamino and $Y_3$ and $Y_4$, independently of one another, are acyloxy or halogen.

7. A recording material according to claim 6, wherein in formula (2) $Y_3$ and $Y_4$ are chlorine or bromine.

8. A recording material according to claim 6, wherein in formula (2) $Y_3$ and $Y_4$ are halogen and ring $A_1$ is a benzene ring which is unsubstituted or substituted by halogen, lower alkyl, lower alkoxy or lower dialkylamino.

9. A recording material according to claim 1, wherein component (A) is a lactone compound of the formula

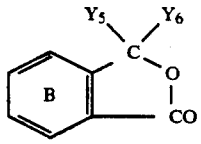

(3)

in which ring B is unsubstituted or substituted by lower alkyl, lower dialkylamino or 1 to 4 chlorine atoms and $Y_5$ and $Y_6$ are bromine or chlorine.

10. A recording material according to claim 1, wherein component (A) is 3,3-dichlorophthalide or 3,3-dibromophthalide.

11. A recording material according to claim 1, wherein components (B) are at least two compounds which are identical or different from one another and are selected from unsubstituted or C-substituted anilines, N-substituted anilines, C- and N-substituted anilines, diarylamines, naphthylamines, N-substituted aminophenylethylene compounds, N-substituted aminophenylstyrene compounds, acylacetarylamides, monohydric or polyhydric phenols, phenol ethers, naphthols, naphtholcarboxanilides, 3-aminophenol ethers, aminopyrazoles, aminothiazoles, pyrazolones, pyridones, pyrroles, thiophenes, quinolones, pyrimidones, barbituric acids, indoles, carbazoles, acridines, benzofurans, benzothiophenes, naphthothiophenes, phenothiazines, pyrrolidines, piperidines, piperazines, morpholines, benzomorpholines, indolines, dihydroquinolines, tetrahydroquinolines, kairolines or julolidines.

12. A recording material according to claim 1, wherein components (B) comprise at least two compounds which are identical to or different from one another and have the formula

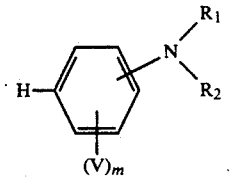

(4)

or the formula

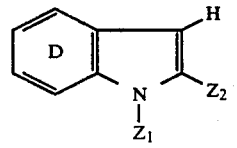

(5a)

or

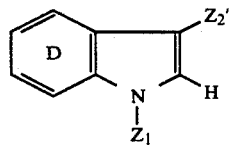

(5b)

in which $R_1$ and $R_2$, independently of one another, are each hydrogen, alkyl which is unsubstituted or substituted by halogen, hydroxy, cyano or lower alkoxy and has a maximum number of 12 carbon atoms, cycloalkyl having 5 to 10 carbon atoms, or phenalkyl or phenyl which is unsubstituted or ring-substituted by halogen, cyano, lower alkyl, lower alkoxy, lower alkoxycarbonyl, —NX'X" or 4—NX'N"—phenylamino in which X' and X", independently of one another, are hydrogen, lower alkyl, cyclohexyl, benzyl or phenyl, or $R_1$ and $R_2$ together with the nitrogen atom which links them are a five- or six-membered heterocyclic radical, V is hydrogen, halogen, lower alkyl, $C_1$–$C_{12}$alkoxy, $C_1$–$C_{12}$acyloxy, benzyl, phenyl, benzyloxy, phenyloxy, halogen-, cyano-, lower alkyl- or lower alkoxy-substituted benzyl or benzyloxy, or the group $-NT_1T_2$ and $T_1$ and $T_2$, independently of one another, are each hydrogen, lower alkyl, $C_5$–$C_{10}$cycloalkyl, unsubstituted or halogen-, cyano-, lower alkyl- or lower alkoxy-substituted benzyl, or acyl having 1 to 8 carbon atoms and $T_1$ is also unsubstituted or halogen-, cyano-, lower alkyl- or lower alkoxy-substituted phenyl, m is 1 or 2, $Z_1$ is hydrogen, unsubstituted or halogen-, hydroxyl-, cyano- or lower alkoxy-substituted alkyl having a maximum number of 12 carbon atoms, acyl having 1 to 12 carbon atoms or unsubstituted or halogen-, cyano-, lower alkyl- or lower alkoxy-substituted benzyl, $Z_2$ is hydrogen, lower alkyl or phenyl and $Z_2'$ is lower alkyl, cyclohexyl, benzyl or phenyl and the benzene ring D is unsubstituted or substituted by halogen, cyano, lower alkyl, lower alkoxy, lower alkoxycarbonyl, amino, lower monoalkylamino or lower dialkylamino.

13. A recording material according to claim 12, wherein the group

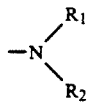

in formula (4) is in the para-position relative to H.

14. A recording material according to claim 12, wherein components (B) comprise two identical aniline compounds of the formula (4) or indole compounds of the formula (5a) or (5b).

15. A recording material according to claim 12, wherein $R_1$ and $R_2$ in formula (4) are each lower alkyl, cyclohexyl, tolyl, benzyl, phenethyl or cyano lower alkyl.

16. A recording material according to claim 12, wherein in formula (4) V is hydrogen, halogen, lower alkyl, $C_1$–$C_8$alkoxy, benzyloxy or —$NT_1T_2$, in which $T_1$ is lower alkyl or $C_1$–$C_8$acyl and $T_2$ is hydrogen or lower alkyl.

17. A recording material according to claim 12, wherein in formula (5a) $Z_1$ is hydrogen, $C_1$–$C_8$alkyl, acetyl, propionyl or benzyl and $Z_2$ is methyl or phenyl.

18. A recording material according to claim 1, wherein at least one component (B) is a fluoran or phthalide compound which contains at least one amino group which is unsubstituted or monosubstituted by lower alkyl, cyclohexyl or benzyl.

19. A recording material according to claim 1, wherein components (B) are 2-methylindole, 2-phenylindole, 1-methyl-2-phenylindole, 3-methyl-6-dimethylaminoindol or 1-(4-dimethylaminophenyl)-1-(4-methoxyphenyl)-ethylen.

20. A recording material according to claim 1, wherein component (C) is an acid clay, a Lewis acid, a solid carboxylic acid or a compound having a phenolic hydroxyl group.

21. A recording material according to claim 1, which is pressure-sensitive.

22. A recording material according to claim 21, wherein components (A) and (B), independently of one another, are dissolved in an organic solvent.

23. A recording material according to claim 22, wherein components (A) and (B), independently of one another, are microencapsulated.

24. A recording material according to claim 21, wherein components (A) and (B) are incorporated in one back layer or independently into two back layers of a transfer sheet and component (C) is present in a front layer of a receptor sheet.

25. A recording material according to claim 21, wherein component (C) is a zinc salt of a salicylic acid derivative, a zinc salt of a phenolic resin or an acid clay.

26. A material according to claim 1 which comprises 1 to 4 layers on a substrate, wherein components (A), (B) and (C) are incorporated each together with a binder in at least one of the layers.

27. A recording material according to claim 1, wherein the colour-forming components (A) and (B) are present together with one or several conventional colour formers.

28. A recording material according to claim 27, wherein the conventional colour formers present are 3,3-bis(aminophenyl)phthalides, 3-indolyl-3-aminophenylaza- or -diazaphthalides, 3,3-bis(indolyl)phthalides, 3-aminofluorans, 6-dialkylamino-2-dibenzylaminofluorans, 6-dialkylamino-3-methyl-2-arylaminofluorans, 3,6-bisalkoxyfluorans, 3,6-bis(-diarylamino)fluorans, leukoauramines, spiropyrans, spirodipyrans, benzoxazines, chromenopyrazoles, chromenoindoles, phenoxazines, phenothiazines, quinazolines, rhodamine lactams, carbazolylmethanes or triarylmethanes.

* * * * *